US006394165B1

(12) United States Patent
Rader

(10) Patent No.: US 6,394,165 B1
(45) Date of Patent: May 28, 2002

(54) SELF-ADHESIVE ELEMENT DISPENSER AND APPLICATOR DEVICE AND METHOD THEREOF

(76) Inventor: Steven M. Rader, 384 Knollglen, Irvine, CA (US) 92614

( * ) Notice: Subject to any disclaimer, the term of this patent is extended or adjusted under 35 U.S.C. 154(b) by 0 days.

(21) Appl. No.: 09/435,951

(22) Filed: Nov. 9, 1999

Related U.S. Application Data

(60) Provisional application No. 60/107,600, filed on Nov. 9, 1998.

(51) Int. Cl.[7] ..... B44C 1/10

(52) U.S. Cl. ..... 156/540; 156/577; 156/579; 156/584; 29/428

(58) Field of Search ..... 156/344, 584, 156/574, 577, 523, 540, 579; 221/71, 72, 73, 74; 29/428

(56) References Cited

U.S. PATENT DOCUMENTS

| | | | | |
|---|---|---|---|---|
| 4,704,185 | A | 11/1987 | Fischer | |
| 4,954,210 | A * | 9/1990 | Desmond | 156/584 |
| 5,581,347 | A | 12/1996 | Rodriguez | |
| 5,806,713 | A | 9/1998 | Dudley et al. | |
| 5,863,384 | A | 1/1999 | Reddy | |
| 5,938,070 | A | 8/1999 | Welborn et al. | |
| 6,171,439 | B1 * | 1/2001 | Groeneweg | 156/584 |

* cited by examiner

*Primary Examiner*—Richard Crispino
*Assistant Examiner*—Cheryl N. Hawkins
(74) *Attorney, Agent, or Firm*—Oppenheimer Wolff & Donnelly LLP

(57) ABSTRACT

A dispenser and applicator device and method thereof is provided for dispensing and applying pressure sensitive self-adhesive elements onto a surface of a workpiece. In particular, the dispenser and applicator device dispenses self-adhesive elements from a roll having the self-adhesive elements carried on a carrier tape. The dispenser and applicator device includes a housing with an opening. A return wheel is rotatively coupled to the housing to advance the carrier-tape and self-adhesive elements. A separator is disposed within the opening for separating the self-adhesive elements from the carrier-tape. A tension arm is disposed within the opening and adjacent the separator, wherein the tension in the carrier-tape is maintained until the last self-adhesive element is separated from the carrier-tape. To load the dispenser and applicator device, the roll of stamps is placed within the housing. The tape-carrier is passed through the separator/tension arm, guided around the around the separator, and attached and wound onto the return wheel. In order to dispense an apply a stamp to a workpiece, the return wheel is rotated, and the carrier-tape with stamps travels towards the separator and tension arm. As the carrier-tape is pulled around the separator, the stamp separates from the carrier-tape and is ejected out of the housing. The adhesive surface of the stamp is then able to come into contact with the workpiece, and the housing is pressed onto the workpiece. To dispense and apply a second stamp, the procedure is repeated.

30 Claims, 5 Drawing Sheets

SELF-ADHESIVE ELEMENT DISPENSER AND APPLICATOR DEVICE AND METHOD THEREOF

RELATED APPLICATIONS

This application claims priority to a Provisional Application Serial No. 60/107,600, filed Nov. 9, 1998.

FIELD OF THE INVENTION

This invention relates generally to a self-adhesive element dispenser and applicator device and method thereof More specifically, the invention relates to a self-adhesive postage stamp dispenser and applicator device and method thereof.

BACKGROUND OF THE INVENTION

Pressure sensitive self-adhesive labels and stickers have been widely used for many years. Recently, the United States Postal Service has introduced postage stamps that are self-adhesive and available in rolls. Several devices are currently available to dispense and apply self-adhesive postage stamps. However, none of the devices thus far appear to be without problems. U.S. Pat. No. 5,806,713 to Dudley et al. discloses a device for dispensing and applying self-adhesive stamps. The device has a housing with a delaminating edge located at the front portion, and the delaminating edge separates stamps from a carrier-tape. A drive roller is located at the rear portion of the housing, and the drive roller pulls the carrier-tape around the delaminating edge. In operation, the device is placed on an envelope laying on a hard flat surface, such as a desk. Moving the device backwards along the surface causes the drive roller to rotate and pull the carrier-tape through the device. The stamp is separated from the carrier-tape as the paper rounds the delaminating edge. The stamp is ejected from the housing through an ejection window and applied to the envelope. However, the device requires a relatively large flat surface because the delaminating edge and drive roller are located at opposite ends of the housing. When working on a relatively small flat surface, it maybe difficult to properly operate the device.

U.S. Pat. No. 5,851,347 to Rodriguez discloses a stamp dispenser and applicator which is more applicable to operating on a relatively small surface. The device has a delaminating edge located adjacent to a drive roller. The device further includes a first and second gear assembly. The first .gear assembly is rotatively attached to the housing and engages with the second gear assembly. A lead-in portion of the carrier-tape is attached to the first gear assembly. The second gear assembly is fixedly attached to the drive roller and rotatably attached to the housing. The drive roller is pulled along a desired surface to rotate the drive roller and the second gear assembly in a clockwise direction. This action, simultaneously rotates the first gear assembly in a counter-clockwise direction to wrap the carrier-tape around the first gear assembly and dispense the stamp against the surface. Although the device is capable of operating on a relatively small surface, it would be preferable to dispense a stamp without pulling or pushing the housing along a surface. In addition, the device comprises several relatively complex elements which may drive up the cost of the device and overly complicate the loading procedure.

U.S. Pat. No. 5,938,070 to Welborn et al. discloses a self-adhesive stamp dispenser which does not require the device to be pushed or pulled along a flat surface to drive a dispensing mechanism. The dispenser comprises a somewhat rectangular housing. Within the housing is a product holder which carries a roll of stamps. The product holder is provided with a tension lever which applies a tension ton the carrier-tape as the stamp is dispensed. The carrier-tape exits the housing through a first slot located in a top portion of the housing, re-enters the housing through a second slot located in a front portion of the housing, and is spooled onto a take-up reel. In order to dispense a stamp, the take-up reel is either rotated on a surface or by hand. As the carrier-tape passes through the second slot, a stamp is separated from the carrier-tape. The stamp is then manually removed from the device using fingers and applied to the desired surface. However, one of the problems with the dispenser is that an operator has to perform the additional step of manually removing a stamp from the dispenser and applying the stamp onto the desired surface. Another problem with the dispenser is that the tensioner is located away from the second slot such that the stamps at the end of the carrier-tape may require manually separating the stamps from the carrier-tape using a finger nail or some other sharp object.

Thus, there remains a need to provide a dispenser and applicator device in an inexpensive, easy to operate, and portable manner.

BRIEF SUMMARY OF THE INVENTION

In accordance with the present invention, a device which can dispense and apply pressure sensitive self-adhesive elements is provided. The present invention achieves these objectives in an inexpensive, easy to operate, and portable manner. In particular, the dispenser and applicator device dispenses self-adhesive elements from a roll having the self-adhesive elements carried on a carrier tape. The device is light weight, simple, easily manipulated when used, easily stored because of its small size, and yet effective in dispensing and applying self-adhesive elements.

The dispenser and applicator devices includes a housing with an opening. A return wheel is rotatively coupled to the housing to advance the carrier-tape and self-adhesive elements. A separator is disposed within the opening for separating the self-adhesive elements from the carrier-tape. A tension arm is disposed within the opening and adjacent the separator, wherein the tension in the carrier-tape is maintained until the last self-adhesive element is separated from the carrier-tape.

Other objects, features, and advantages of the present invention will become apparent from a consideration of the following detailed description.

DETAILED DESCRIPTION OF THE PREFERRED EMBODIMENTS

Figure 1:
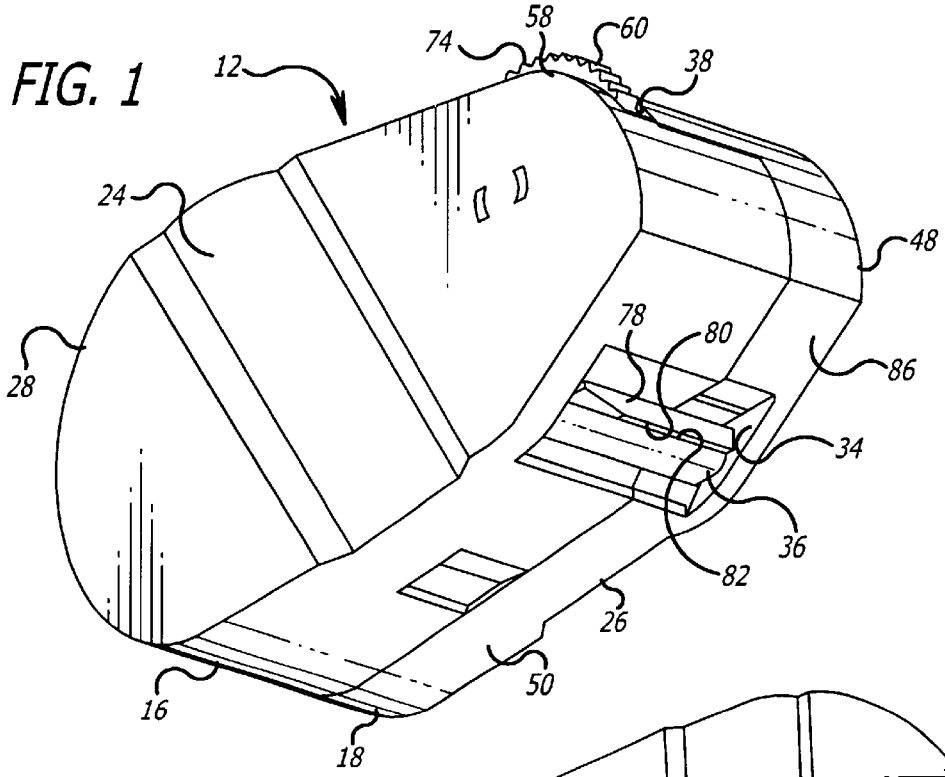
FIG. 1 is a perspective view of a preferred exemplary embodiment of a dispenser and applicator device in accordance with the present invention.

The present invention relates to a dispenser and applicator device for dispensing and applying self-adhesive elements. In the particular embodiment shown in the drawings and herein described, the device is designed to be hand held and is suited to dispense and apply self-adhesive postage stamps from a roll comprising a tape-carrier attached to the backside of a ribbon of stamps in which a series of perforations are provided for separating each stamp from the remaining ribbon of stamps. However, it should be understood that the principles of the present invention are equally applicable for dispensing other types of self-adhesive elements such as stickers, labels, and the like. Therefore, it is not intended to limit the principles of the present invention to the specific embodiments shown and such principles should be broadly construed.

Referring to FIGS. 1–6, the dispenser and applicator device 10 is provided with a plastic molded housing 12 suitable for being hand held by virtue of its size and light weight and is configured to dispense and apply 1 inch by 1 inch self-adhesive postage stamps 14. The housing 12 has a generally oval shape with a length of about 4.5 inches, a width of about 2.0 inches, and a thickness of about 1.5 inches. The housing 12 comprises a first shell 16 and a second shell 18 which are snap fitted together by a latch 20 and recess 22 arrangement. A pair of grooves 24, 26 extend across the outer face of the first 16 and second shell 18 to aid in holding the device 10. The housing 12 is designed for ambidextrous usage where a right-handed user may hold the device 10 by apply the middle finger on right groove 24 and the thumb on the left groove 26, while the palm rests against a rear portion 28 of the housing 12 and the index finger is free to operate an advancing mechanism which is discussed in detail below. A left-handed user may operate the device 10 in a similar fashion wherein the left hand may be used to hold the device 10 by applying the thumb on the right groove 24 and the middle finger on the left groove 26, while the palm rests against the rear portion 28 of the housing 12 and the index finger is free to operate the advancing mechanism. The housing 12 may be sized and shaped in other forms to accommodate different purposes such as the dispensing and applying larger or smaller sized postage stamps, or the dispensing and application of other types of self-adhesive elements such as stickers and labels.

In the particular embodiment shown in the drawings and herein described, the first 16 and second shell 18 are formed from a clear plastic to allow visual inspection of the stamps within the housing 12. Preferably, the first 16 and second shell 18 are molded from a high impact and inexpensive plastic material such as a general purpose polycarbonate. It is noted that other materials exhibiting similar qualities may also be used to form the first and second shell such as polypropylene, polystyrene, polyethylene, polyvinyl chloride, acetyle, and the like. The first 16 and second shell 18 may also be formed from non-plastic materials such as aluminum, steel, magnesium, or other metals, and a viewing window maybe provided to allow visual inspection of the stamps.

Figure 2:
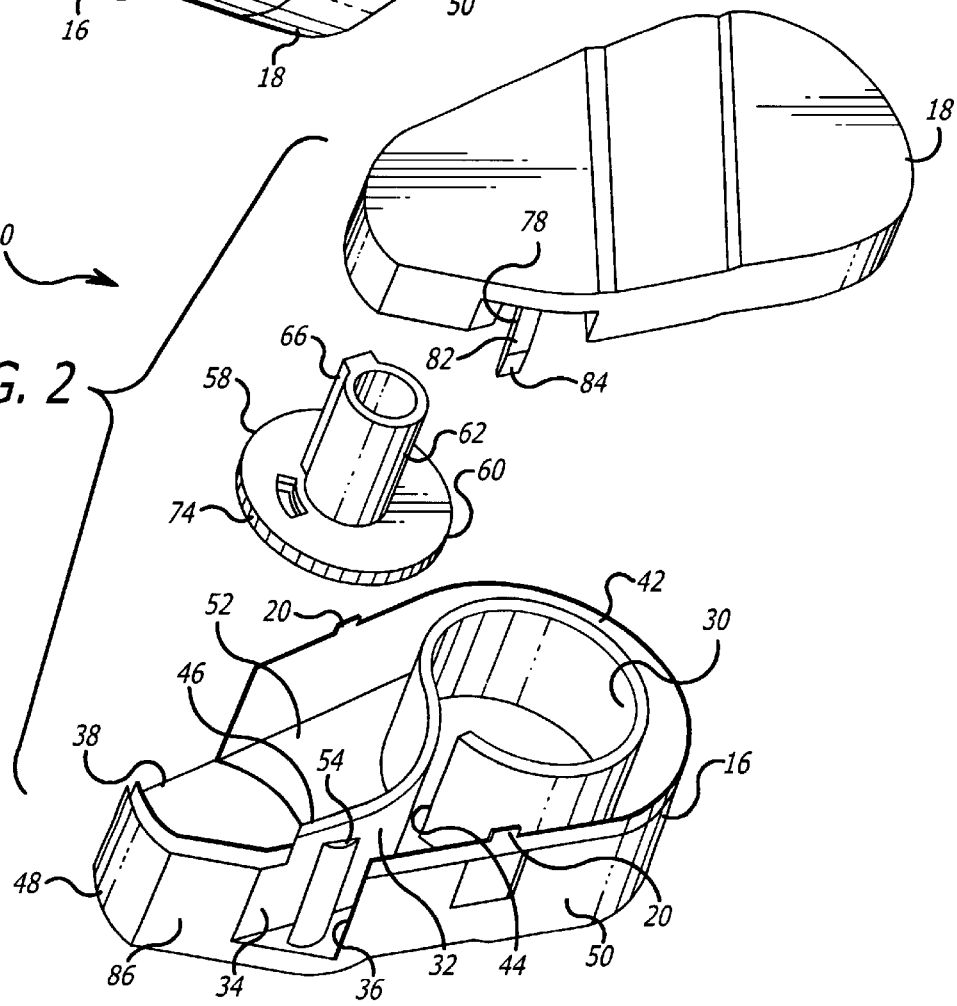
FIG. 2 is an exploded view of the device of FIG. 1.
Figure 3:
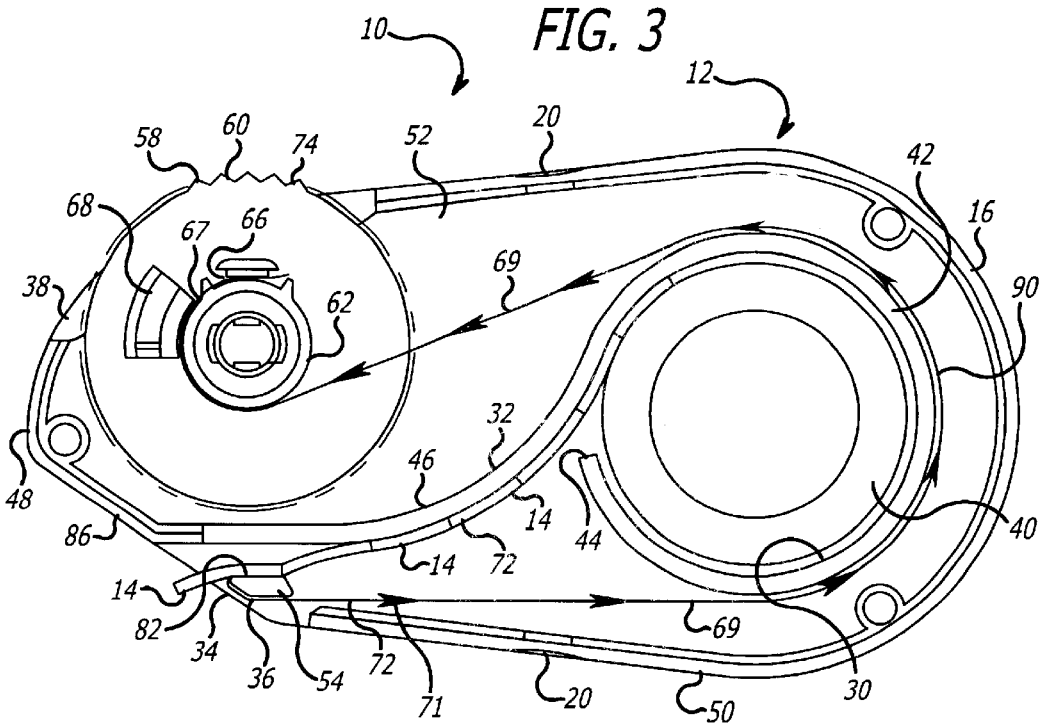
FIG. 3 is a plan view of the device of FIG. 1 without a top cover.

As shown in FIGS. 2–3, the first shell 16 includes a supply chamber 30, a guide 32, an ejection window 34, a separator 36, and a return wheel access window 38. The supply chamber 30 receives the roll 40 of stamps 14 and comprises a cylindrical-shaped wall 42 with an opening 44, and the guide 32 comprises a wall 46 extending from the cylindrical-shaped wall 42 to the ejection window 34. The ejection window 34 is located near a front 48 and lower 50 region of the housing 12 and may be a rectangular-shaped opening extending substantially across the longitudinal length of the housing 12 from the outer face of the first shell 16 to the outer face of the second shell 18. In the embodiment shown in FIGS. 1–6, the ejection window 34 is slightly larger than 1 inch to accommodate the 1 inch by 1 inch postage stamps 14. It is noted that ejection window can be formed in various other sizes to accommodate larger or smaller postage stamps, and it is also contemplated that the size of the ejection window may be designed to be adjustable (not shown). The separator 36 is a rectangular-shaped member disposed within the ejection window 34 and extends outwardly from the interior face 52 of the first shell 16 and has an end 54 which abuts against the interior surface 56 of the second shell 18.

Figure 5:
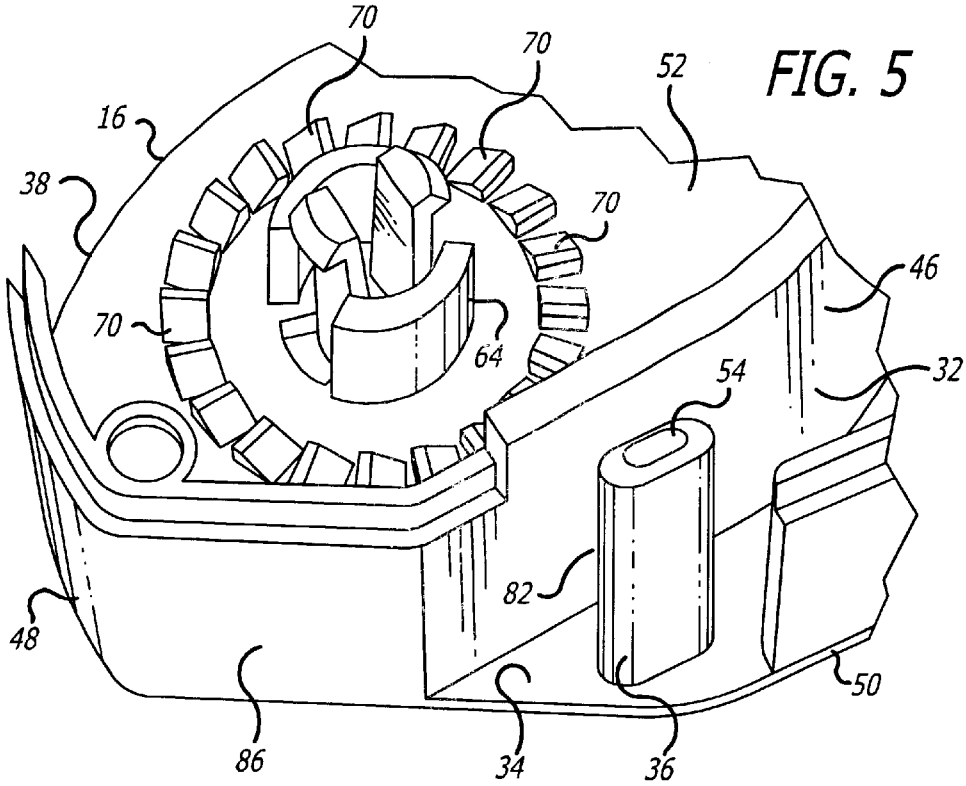
FIG. 5 is a close-up perspective view of the front portion of the housing.
Figure 6:
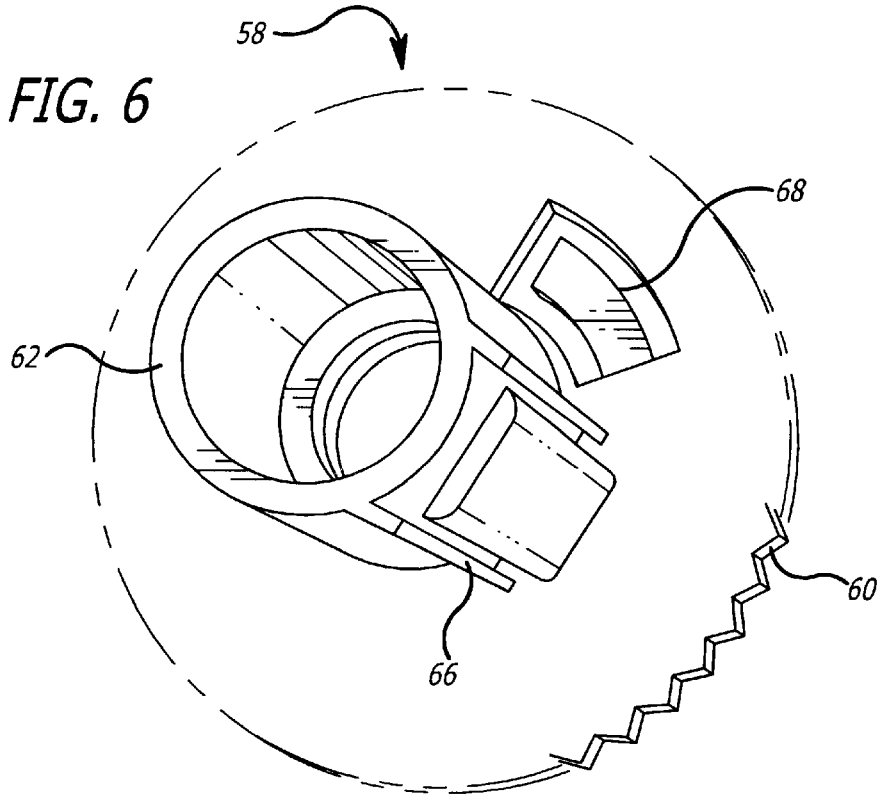
FIG. 6 is a close-up perspective view of a return wheel.

As shown in FIGS. 3, 5, and 6, a return wheel 58 comprises a disk 60 and a hub 62 which may be integrally formed. The hub 62 is rotatably mounted onto a shaft 64 extending outwardly from the interior surface 52 of the first shell 16. The hub 62 has a slot 66 for receiving a first end 67 of a feeder-tape 69. A second end 71 of the feeder-tape 69 is attached to a lead-in portion of the roll 40 of stamps 14, wherein the second end 71 includes a Y-shaped connector with self-adhesive internal surfaces. The disk 60 has a detent 68 which engages with a plurality of angled-cam surfaces 70 arranged in a circular fashion and extending outwardly from the interior surface 52 of the first shell 16. The detent 68 and angled-cam surfaces 70 allow the return wheel 58 to be rotated in the clockwise direction but restrict rotation in the counter-clockwise direction. A portion of the disk 60 extends outwardly beyond the housing 12 through the return wheel access window 38 to provide access to the disk 60, wherein the user is able to rotate the return wheel 58 with an index finger. By rotating the return wheel 58, successive stamps 14 are advanced and the carrier-tape 72 without stamps 14 is spooled onto the hub 62 of the return wheel 58. In order to facilitate rotation of the return wheel 58, an outer surface of the disk 60 can be formed in a saw-tooth 74 manner to provide a gripping surface for the index finger.

Figure 4:
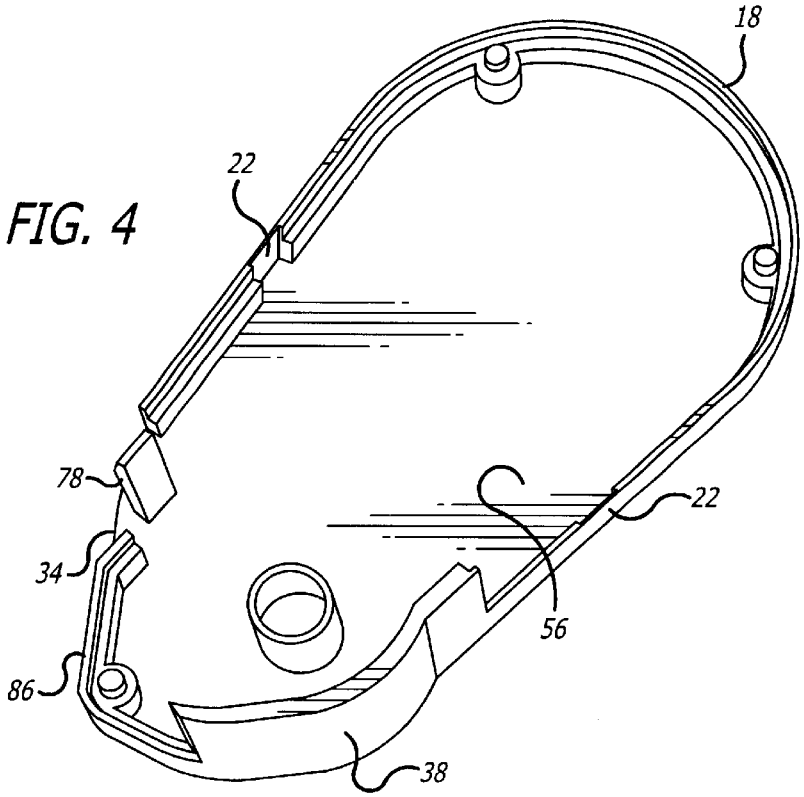
FIG. 4 is a perspective view of the top cover of FIG. 1.

As shown in FIG. 4, the second shell 18 includes a shaft 76 and a tension arm 78. The shaft 76 extends outwardly from the interior surface 56 of the second shell 18, and the return wheel 58 is rotatably mounted onto the shaft 76 when the first 16 and second shell 18 are snap fitted together. The tension arm 78 is a substantially rectangular-shaped member extending outwardly from the interior surface 56 of the second shell 18. When the first 16 and second shell 18 are snap fitted together, the tension arm 78 is positioned adjacent the separator 36 such that a separation distance is provided between a contact surface 80 of the tension arm 78 and a contact surface 82 of the separator 78. It is contemplated that the separation distance is equivalent to the combined thickness of the carrier-tape 72 and stamp. However, the tension arm 78 and separator 78 may be configured with a separation distance which is greater or less than the combined thickness of the carrier-tape 72 and stamp 14. As the carrier-tape 72 with stamps 14 are fed between the tension arm 78 and the separator 78, the tension arm 78 presses the carrier-tape 72 with stamps 14 against the contact surface 82 of the separator 78 and maintains tension in the carrier-tape 72 from the tension arm 78 to the return wheel 58. A feed edge 84 of the tension arm 78 is tapered to allow easy passage of the carrier-tape 72 with stamps.

As shown in FIGS. 1 and 5, the housing 12 further includes a fixing face 86 disposed adjacent to and down stream of the ejection window 34. The fixing face 86 is a flat surface formed integrally with the first 16 and second shell 18, and the stamp 14 is advanced onto the fixing face 86 after being separated from the carrier-tape 72 and ejected from the ejection window 34.

To load the dispenser and applicator device 10, the second end 71 of the feeder-tape 69 is attached to the lead-in portion of the carrier-tape 72. The roll 40 is placed in the supply chamber 30 and allowed to expand until it abuts against an inner surface 88 of the cylindrical-shaped wall 42. The feeder-tape 69 is passed through the opening 44 of the supply chamber 30 and is fed along the guide 32 to the separator 36. The feeder tape 69 is pulled around the separator 36 and fed along an outer surface 90 of the cylindrical-shaped wall 42. The first end 67 of the feeder-tape 69 is inserted into the slot 66 of the return wheel 58 and wound onto the return wheel 58. Of course, the first end 67 of the feeder-tape 69 may be attached to the return wheel 58 with tape or other means known in the art. As the second shell 18 is snap fitted to the first shell 16, the tension arm 78 is positioned such that the feeder-tape 69 is disposed between the tension arm 78 and the separator 36.

As shown in FIG. 3, the feeder-tape 69 follows the path indicated by the arrows. In order to dispense and apply a stamp to a workpiece, the return wheel 58 is rotated in the clockwise direction using an index finger, and the carrier-tape 72 with the attached stamps travels towards the separator 36 and tension arm 78. As the carrier-tape 72 is pulled around the separator 36, the stamp 14 separates from the carrier-tape 72 and is positioned over the fixing face 86. The adhesive surface of the stamp 14 is then able to come in contact with the workpiece, and the fixing face 86 is pressed onto the workpiece. After separating from the stamps, the carrier-tape 72 continues along the outer surface 90 of the cylindrical-shaped wall 42 and is wound onto the return wheel 58 for storage. To dispense and apply a second stamp, the procedure described above is repeated. One of the advantages of the device 10 is that the tension arm 78 is able to maintain tension in the carrier-tape 72 during the dispensing and application of the last stamp in the roll 40. After the last stamp has been applied, the housing 12 is opened by removing the second shell 18, and the carrier-tape 72 is unwound from the return wheel 58 and discarded.

Figure 7:
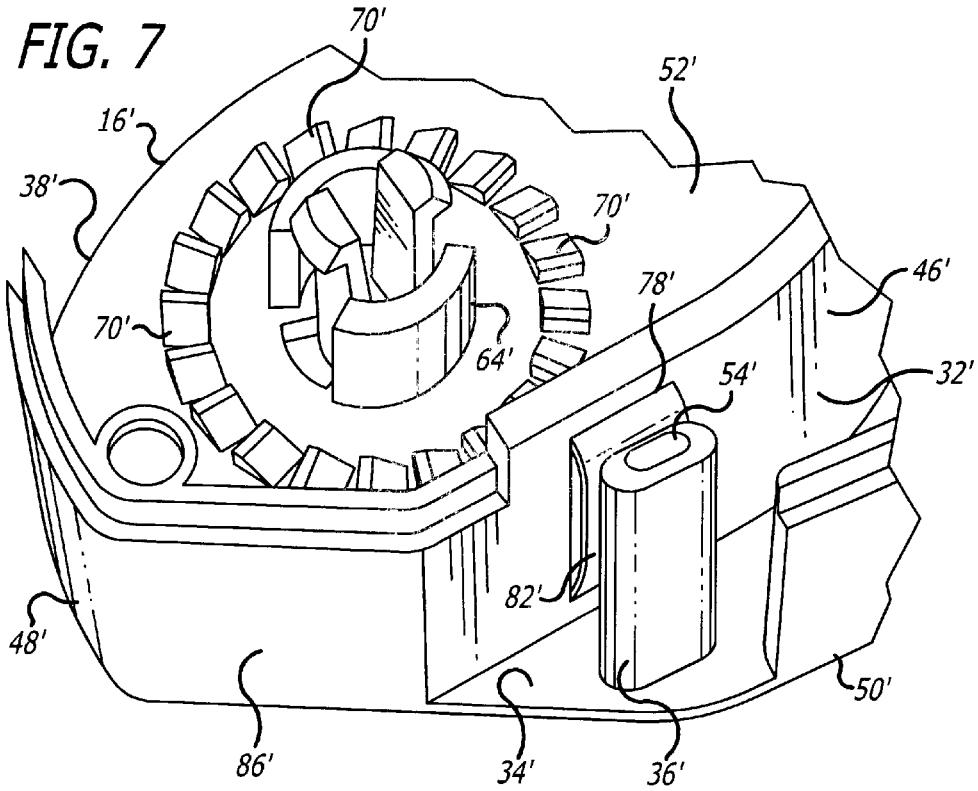
FIG. 7 is a close-up perspective view of an alternative housing for use in the dispenser and applicator device of FIG. 1 in accordance with the present invention.

Referring to FIG. 7, an alternative embodiment of the dispenser and applicator device 10 is shown. Like components are numbered with the same number and with a prime. The alternative embodiment is similar to the previous embodiment shown in FIGS. 1–6 with the exception that a tension arm 78' is formed integrally with a first shell 16'. One of the advantages of this alternative embodiment is that the tension arm 78' is protected within an ejection window 34' of the first shell 16' and is therefore less likely to be damaged. The procedure for loading a roll 40 of stamps and dispensing/applying a stamp is similar to the previous embodiment. However, during the loading procedure, the feeder-tape 69 is passed between the separator 36' and the tension arm 78', and then pulled around the separator 36'. Thus, the user is not required to properly position the tension arm 78' when snap fitting the second shell (not shown) onto the first shell 16'.

Figure 8:
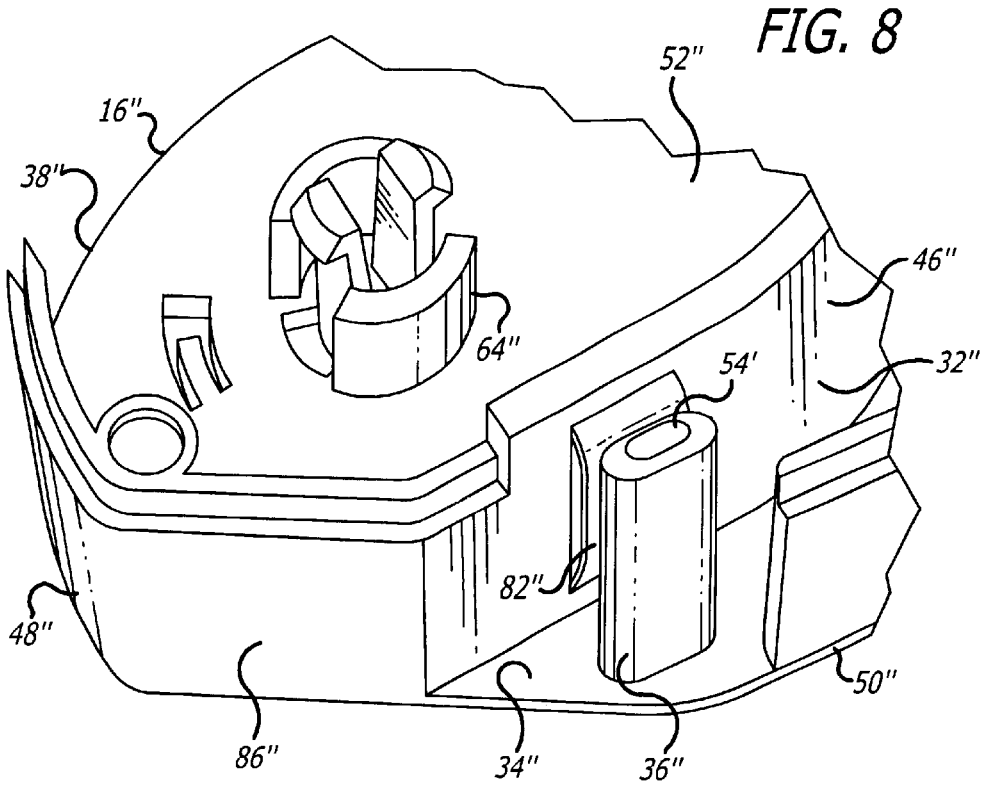
FIG. 8 is a close-up perspective view of another alternative housing for use in the dispenser and applicator device of FIG. 1 in accordance with the present invention.
Figure 9:
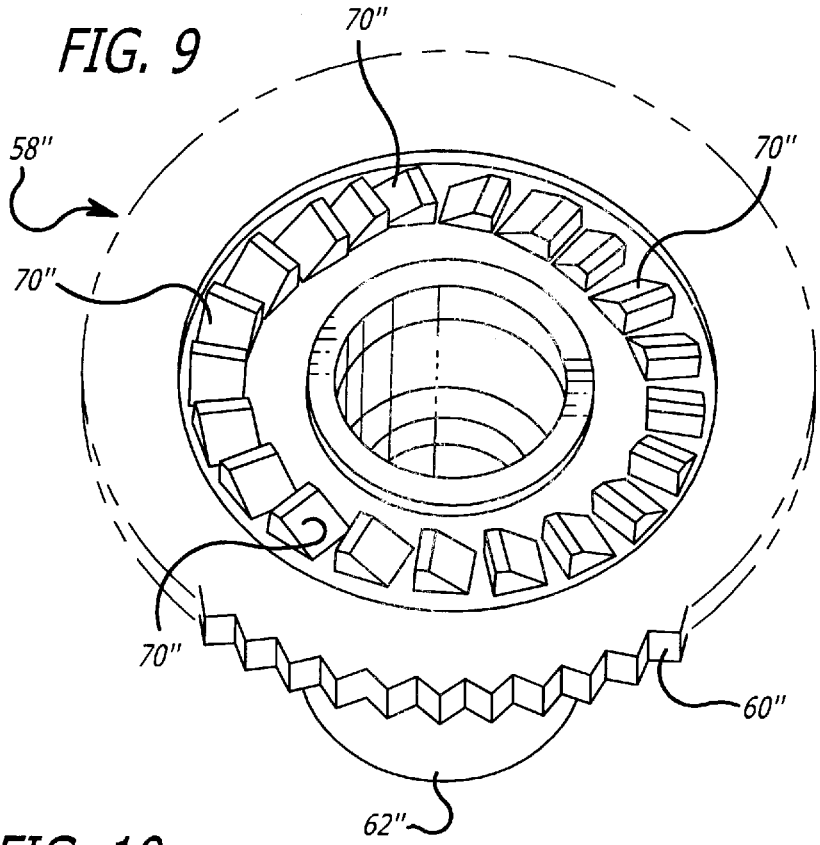
FIG. 9 is a close-up perspective view of a return wheel for the housing of FIG. 8.

Referring to FIGS. 8–9, another alternative embodiment of the dispenser and applicator device 10 is shown. Like components are numbered with the same number and with a double prime. The alternative embodiment is similar to embodiment described in FIGS. 1–6 with the exception that a return wheel 58" is restricted from rotating in the counterclockwise direction by having a detent 68" formed on a first shell 16" and angled cam surfaces 70" formed on a disk 60". The procedure for loading a roll of stamps and dispensing/applying a stamp is identical to the procedure described for the device describe in FIGS. 1–6.

Figure 10:
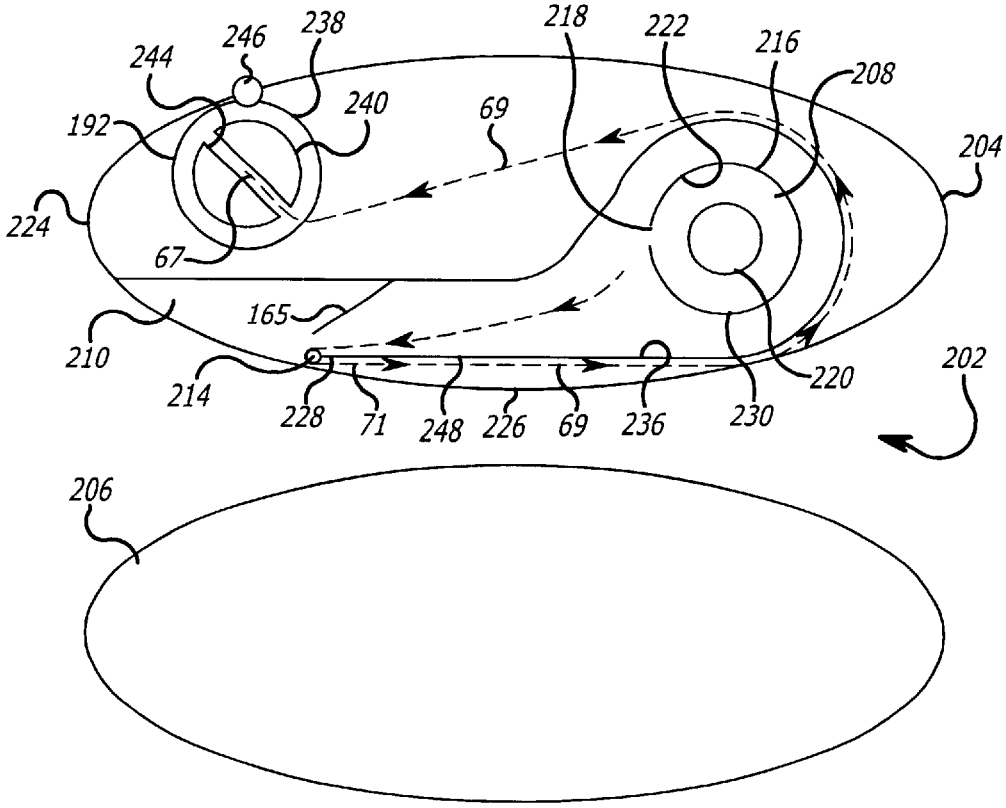
FIG. 10 is a plan view of another alternative embodiment of a dispenser and applicator device in accordance with the present invention.

Referring to FIG. 10, another alternative embodiment of the dispenser and applicator device 10 of the present invention is shown. The alternative embodiment is provided with a plastic molded housing 202 suitable for being hand held and is configured to dispense and apply 1 inch by 1 inch self-adhesive postage stamps. The housing 202 is oval-shaped and comprises a first 204 and second shell 206 which are fitted together. It is noted that the housing 202 may be sized and shaped in other forms to accommodate different sized postage stamps or other types of self-adhesive elements such as stickers and labels.

As shown in FIG. 10, the first shell 204 includes a supply chamber 208, an ejection window 210, a guide wall 212, and an ejection point 214, and a tension arm 165. The supply chamber 208 comprises a cylindrical-shaped wall 216.with an opening 218. The supply chamber 208 includes a spindle 220 for receiving the roll 40 of stamps 14, and the spindle 220 is rotatively coupled to the supply chamber 208 such that the carrier-tape 72 and stamps are advanced from the spindle 220 and exit the supply chamber 208 through the opening 218. The supply chamber 208 may alternatively be formed without a spindle 220, wherein the roll of stamps is free to expand and abut against the inner surface 222 of the cylindrical-shaped wall 216.

The ejection window 210 is located near the front and lower region 226 of the housing 202. The guide 212 wall has a first end 228 located near the ejection window 210 and extends towards and around the cylindrical-shaped wall 216. The guide wall 212 continues past the cylindrical-shaped wall 216 and terminates at a second end which is located above the first end 228. The ejection point 214 may be any flat edge which extends across the longitudinal length of the housing 202. In this alternative embodiment, the ejection point 214 is integrally formed with the first end 228 of the guide wall 212 and has a length slightly greater than 1 inch. The tension arm 165 is a rectangular shaped member extending outwardly near the second end 232 of the guide wall 212, wherein a flat surface of the tension arm 165 is pushed against an inner surface 236 of the guide wall 212. It is noted that the tension arm 165 may be configured in various other forms as long as it is capable of maintaining tension in the carrier-tape 72.

As shown in FIG. 10, a return wheel 238 is disposed within the housing 202 and is rotatively mounted to the first shell 204 and is restricted to rotate in only the clockwise direction. The return wheel 238 has a hub 240 and an engagement disk 192, and the hub 240 has a slot 244 for receiving the first end 67 of the feeder-tape 69 or paper feed. A feed wheel 246 is rotatively coupled to the first shell 204 and the return wheel 238 A portion of the feed wheel 246 protrudes from the housing 202 so that a user may rotate the feed wheel 246. By rotating the feed wheel 246 in the counterclockwise direction, the return wheel 238 rotates in the clockwise direction and successive stamps are advanced, and the carrier-tape 72 is spooled onto the hub 240 of the return wheel 238.

To load the dispenser and applicator device 150, the second end 71 of the feeder-tape 69 is attached to the lead-in portion of the carrier-tape 72. The roll 40 of stamps 14 is fed onto the spindle 220, and the spindle 220 is placed in the supply chamber 208. The feeder-tape 69 is passed through the opening 218 of the supply chamber 208, fed along an inner surface 236 of the guide wall 212, passed between the tension arm 165 and ejection point 214, and pulled around the ejection point 214. The feeder-tape 69 is then fed along an outer surface 248 of the guide wall 212, the end of the lead-in portion is inserted into the slot 244 of the return wheel 238 and wound onto the hub 240, and the second shell 206 is snap fitted to the first shell 204.

As shown in FIG. 10, the feeder-tape 69 follows the path indicated by the arrows. In order to dispense and apply the stamp 14 to a work piece, the feed wheel 246 is rotated in the counter-clockwise direction using an index finger. The feed wheel 246 rotates the return wheel 238 rotates in the clockwise direction, and the carrier-tape 72 with stamps 14 travels towards the tension arm 165 and ejection point 214. As the carrier-tape 72 is pulled around the ejection point 214, the stamp 14 separates from the carrier-tape 72 and is ejected from the housing 202. The housing 202 is positioned over the work piece and the housing 202 is pressed against and pulled along the surface of the workpiece at a 45 degree angle, forcing the stamp 14 onto the surface of the workpiece. After separating from the stamps, the carrier-tape 72 continues along the outer surface 248 of the guide wall 212 and is wound onto the return wheel 238 for storage. The procedure may be repeated to dispense and apply additional stamps. When the last stamp is being separated from the carrier-tape 72, the carrier tape 72 is no longer attached to the spindle 220. Tension in the carrier-tape 72 is provided by the tension arm 165 pressing the carrier-tape 72 against the inner surface of the guide wall 212. After the last stamp has been applied, the housing 202 is opened and the carrier-tape 72 is unwound from the return wheel 238 and discarded.

The foregoing detailed description and the accompanying drawings describe illustrative preferred embodiments of the invention, Other arrangements may be provided along the same likes. Thus, by way of example and not of limitation, the return wheel 238 may be rotated to eject a plurality of stamps which remain connected, and the plurality of stamp may be applied to the surface of the workpiece. Accordingly, the invention is not limited to the precise embodiment shown in the drawing and described in detail hereinabove.

What is claimed is:

1. An apparatus for dispensing and applying self-adhesive elements from a roll having the self-adhesive elements carried on a carrier-tape, comprising:

a housing having a first opening disposed at an upper and frontal region of the housing and a second opening disposed at a lower and frontal region of the housing;

a supply chamber within the housing for retaining the roll, wherein the supply chamber comprises a cylindrical-shaped wall having an inner surface and an outer surface, wherein the roll is allowed to expand and abut against the inner surface of the cylindrical-shaped wall, and wherein the carrier-tape passes through an opening in the supply chamber, extends towards and around a separator, extends towards the supply chamber and along the outer surface of the cylindrical-shaped wall and towards the return wheel;

the return wheel rotatively coupled to the housing, wherein the roll being connected to the return wheel for spooling the carrier-tape, wherein a portion of the return wheel extends outwardly from the housing through the first opening such that a user may turn the return wheel;

the separator disposed within the second opening for separating the self-adhesive elements from the carrier-tape; and a tension arm disposed within the second opening and adjacent the separator, wherein the tension arm maintains tension in the carrier-tape between the tension arm and the return wheel;

wherein tension in carrier-tape is maintained until the last self-adhesive element in the roll is separated from the carrier-tape.

2. The apparatus of claim 1, wherein the separator and tension arm are elongated members extending across the longitudinal length of the housing, and wherein the tension arm is integral with the housing.

3. The apparatus of claim 1, further comprising a separation distance between a contact surface of the tension arm and a contact surface of the separator.

4. The apparatus of claim 1, wherein the housing has one side completely open for insertion and removal of the roll and the return wheel, the housing further comprising a cover adapted to cover the open side of the housing, wherein the tension arm being fixedly secured to the cover, the carrier-tape and self-adhesive elements being fed between the tension arm and the separator.

5. The apparatus of claim 1, wherein the housing comprises a transparent plastic to allow a user to visually inspect the self-adhesive elements.

6. The apparatus of claim 1, wherein the exposed portion of the return wheel is adapted to be turned by an index finger of the user.

7. The apparatus of claim 1, further comprising a fixing face disposed near the front and lower portion of the housing and adjacent the second opening, the fixing face facing towards and freely accessible to workpieces such that the self-adhesive element can be transferred to the workpiece by a user advancing the self-adhesive element onto the fixing face and pressing the fixing face against the surface of the workpiece.

8. The apparatus of claim 7, wherein the fixing face is integral with the housing.

9. The apparatus of claim 1, wherein the return wheel has a detent and the housing has plurality of angled-cam surfaces, and wherein the detent engages with the plurality of angled-cam surfaces such that the return wheel is restricted to rotate in only one direction.

10. The apparatus of claim 1, wherein the return wheel has a plurality of angled-cam surfaces and the housing has a detent, and wherein the detent engages with the plurality of angled-cam surfaces such that the return wheel is restricted to rotate in only one direction.

11. A tool for dispensing and applying self-adhesive elements from a roll having the self-adhesive elements carried on a carrier-tape, the tool comprising:

a housing having an opening;

a return wheel rotatively coupled to the housing to advance the carrier-tape and self-adhesive elements;

a separator disposed within the opening for separating the self-adhesive element from the carrier-tape;

a tension arm disposed within the opening and adjacent the separator, wherein tension in the carrier-tape is maintained until the last self-adhesive element is separated from the carrier-tape; and a supply chamber within the housing for retaining the roll, wherein the supply chamber includes a cylindrical-shaped wall having an inner surface and an outer surface, wherein the roll is allowed to expand and abut against the inner surface of the cylindrical-shaped wall, and wherein the carrier-tape passes through an opening in the supply chamber, extends towards and around the separator, extends towards the supply chamber and along the outer surface of the cylindrical-shaped wall and towards the return wheel.

12. The tool of claim 11, further comprising an additional opening, wherein the opening is disposed at a lower and frontal region of the housing and the additional opening is disposed at an upper and frontal region of the housing, and wherein a portion of the return wheel extends outwardly from the additional opening so that a user may advance successive self-adhesive elements by rotating the return wheel.

13. The tool of claim 12, wherein the return wheel is adapted to be rotated by an index finger of the user.

14. The tool of claim 11, further comprising a supply chamber within the housing for retaining the roll, wherein the supply chamber is integral with the housing.

15. The apparatus of claim 11, wherein the separator and tension arm are elongated members extending across the longitudinal length of the housing.

16. The apparatus of claim 11, wherein the tension arm is integral with the housing.

17. The apparatus of claim 11, wherein the tension arm presses the carrier-tape and self-adhesive elements against the separator to maintain tension in the carrier-tape.

18. The apparatus of claim 11, wherein the self-adhesive elements are self-adhesive postage stamps.

19. The apparatus of claim 11, further comprising a fixing face disposed near the front and lower portion of the housing and adjacent the opening, the fixing face facing towards and freely accessible to workpieces such that the self-adhesive element can be transferred to the workpiece by the user advancing the self-adhesive element onto the fixing face and pressing the fixing face onto the workpiece.

20. The apparatus of claim 19, wherein the fixing face is integral with the housing.

21. A method of making an apparatus for dispensing and applying self-adhesive elements from a roll having the self-adhesive elements carried on a carrier-tape, comprising:

providing a housing with an opening and a supply chamber, wherein the supply chamber includes a cylindrical-shaped wall having an inner surface and an outer surface, wherein the roll is allowed to expand and abut against the inner surface of the cylindrical-shaped wall, and wherein the carrier-tape passes through an opening in the supply chamber, extends towards and around a separator, extends towards the supply chamber and along the outer surface of the cylindrical-shaped wall and towards a return wheel;

rotatively coupling a return wheel to the housing;

attaching the roll to the return wheel such that a user advances the roll by rotating the return wheel;

providing a separator within the opening for separating the self-adhesive elements from the carrier-tape;

providing a tension arm within the opening and adjacent the separator; and positioning the carrier-tape between the separator and the tension arm, whereby the tension arm maintains tension in the carrier-tape from the tension arm to the return wheel.

22. The method of claim 21, further comprising:

providing the housing with an additional opening;

whereby the opening is disposed at a lower and frontal region of the housing and the additional opening is disposed at an upper and frontal region of the housing;

whereby a portion of the return wheel extends outwardly beyond the additional opening;

whereby the return wheel is advanced by a user; and whereby successive self-adhesive elements are advanced when the return wheel is rotated.

23. The method of claim 21, further comprising maintaining tension in the carrier-tape until the last self-adhesive element is separated from the carrier tape.

24. The method of claim 21, further comprising providing a supply chamber within the housing for retaining the carrier-tape, wherein the chamber is integral with the housing.

25. The method of claim 21, whereby tension is maintained in the carrier-tape from the tension arm to the return wheel by the tension arm pressing the tape-carrier against the separator.

26. The method of claim 21, further comprising:

providing a fixing face near a front and lower portion of the housing and adjacent the opening, whereby the self-adhesive element is advanced on the fixing face; and pressing the fixing face onto a desired portion of a workpiece such that the self-adhesive element is provided thereon.

27. The method of claim 26, wherein the fixing face is integral with the housing.

28. A method of dispensing and applying self-adhesive elements, comprising;

providing a device comprising:

a housing having an opening and a supply chamber, wherein the supply chamber includes a cylindrical-shaped wall having an inner surface and an outer surface, wherein the roll is allowed to expand and abut against the inner surface of the cylindrical-shaped wall, and wherein the carrier-tape passes through an opening in the supply chamber, extends towards and around a separator, extends towards the supply chamber and along the outer surface of the cylindrical-shaped wall and towards a return wheel;

the return wheel rotatively coupled to the housing;

the separator disposed within the opening; and a tension arm disposed within the opening and adjacent the separator; providing a roll of self-adhesive elements on a carrier-tape, attaching the carrier-tape to the return wheel;

positioning the carrier-tape between the separator and the tension arm;

rotatably positioning the roll in the housing; and turning the return wheel to advance the carrier-tape such that a self-adhesive element is separated from the carrier-tape as the carrier-tape engages the separator, whereby the tension arm pushes the carrier-tape against the separator to maintain tension in the carrier-tape from the return wheel to the tension arm.

29. The method of claim 28, further comprising:

providing the housing with an additional opening, whereby the opening is disposed at a lower and frontal region of the housing and the additional opening is disposed at an upper and frontal region of the housing, whereby a portion of the return wheel;

providing a roll supply chamber, wherein the roll is positioned within the chamber, providing a fixing face near a front and lower portion of the housing and adjacent the opening; and pressing the fixing face onto a desired portion of a workpiece such that the self-adhesive element is provided thereon.

30. The method of claim 28, further comprising:

providing a feeder-tape with a first end and a second end;

attaching the second end of the feeder-tape to the carrier-tape; and attaching the first end of the feeder-tape to the return wheel.

* * * * *